US006926258B1

(12) United States Patent
Sowa et al.

(10) Patent No.: US 6,926,258 B1
(45) Date of Patent: Aug. 9, 2005

(54) BIASED STRAP TENSION RETAINING DEVICE

(75) Inventors: Paul Sowa, Wheeling, IL (US); Michael Kaufman, Morton Grove, IL (US); Lawrence Promise, Matteson, IL (US); Mark Hughes, West Dundee, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/937,032

(22) Filed: Sep. 9, 2004

(51) Int. Cl.[7] ..... B65H 77/00; B65D 63/10; B25B 25/00

(52) U.S. Cl. ..... 254/231; 254/225; 254/246; 254/262; 254/414; 53/399; 206/597; 206/430; 410/100; 100/29

(58) Field of Search ..... 254/225, 231, 254/232, 233, 234, 216, 213, 262, 256, 246, 254/250, 389, 414; 53/399, 582; 206/386, 206/595–600, 499, 525, 526, 427–435; 410/100, 410/49, 47; 100/29, 32

(56) References Cited

U.S. PATENT DOCUMENTS 3,957,285 A * 5/1976 Schlaeger ..... 410/100
4,314,783 A * 2/1982 Parnell et al. ..... 410/34
5,035,323 A * 7/1991 Daniels et al. ..... 206/386
5,417,034 A * 5/1995 Gabler et al. ..... 53/399
5,975,455 A * 11/1999 Alegre ..... 242/396.4
6,318,692 B1 * 11/2001 Cyrell ..... 248/317
6,578,346 B1 * 6/2003 Sowa ..... 53/399
6,821,068 B2 * 11/2004 Facey et al. ..... 410/100

* cited by examiner

*Primary Examiner*—John M. Jillions
*Assistant Examiner*—Evan Langdon
(74) *Attorney, Agent, or Firm*—Mark W. Croll, Esq.; Donald J. Breh, Esq.; Welsh & Katz, Ltd.

(57) ABSTRACT

A strap tension retaining device is configured for a use with a bulk unit secured by a strap under tension. Such a bulk unit load has a corner and defines a bulk unit perimeter. The strap tension retaining device includes a fixed base element, fixed relative to the bulk unit load, a floating element movable relative to the fixed base element, a biasing element mounted between the floating element and the fixed base element and a guide element mounting the floating element to the fixed base element to guide movement of the floating element relative to the fixed base element. The strap tension retaining device is positioned at about the corner of the bulk unit load with the strap positioned around the bulk unit perimeter of the bulk unit load, over the strap tension retaining device floating element. When the strap is tensioned a force is exerted by the strap on the floating element to force the biasing element against the bias direction. Changes in strap tension due to a decrease or increase in the bulk unit perimeter are accommodated by movement of the floating element.

12 Claims, 2 Drawing Sheets

BIASED STRAP TENSION RETAINING DEVICE

BACKGROUND OF THE INVENTION

The present invention relates to a tension retaining device for use on a strapped bulk unit load. More particularly, the present invention relates to a biased strap tension retaining device for maintaining the tension in a strapped bulk unit load when the bulk unit normally increases or decreases in size.

Material bulk unit loads (products) are often unitized or strapped to facilitate handling of the bulk unit loads. As is often the case, there may be a large quantity of products, for example, stacked on and strapped to a pallet. Sometimes, in order to more efficiently store or warehouse the products, pallets of goods are stacked onto one another.

In the event that the products are stable in size, there is generally no concern with such stacking. However, when the products are not stable in size i.e. compressible or expandable, the straps may loosen or tighten (due to changes in the volume of products), and as a result the bulk unit load may no longer be stable. While this may not be problematic for certain products, however, it can be quite problematic for other products.

There are also certain products that are compressible. That is, when multiple pallets are stacked on one another, the product compress to a minimal extent, although they appear (visually) not to have undergone any compression at all. For example, plastic (polyethylene terephthalate or PET) beverage bottles are often shipped to a bottler on a pallet in multiple layers (bulk unit). In that the empty bottles are light-weight, the bulk units can be stacked on one another for storage.

When bulk units are stacked, the compression on the lower or bottom bulk units results in slack developing in the strap. An increase or decrease in bulk unit height can also occur due to product expansion or contraction. This can also be viewed as a reduction or enlargement in the perimeter of the bulk unit load. The reduction (or occurrence of slack) can be problematic in that the strap material may no longer retain the products in compression. As such, the bulk unit load may become unstable and the product can easily fall out of the bulk unit. In addition, an enlargement in the product may cause product damage from excessive strap tension or exceed the strap burst strength, resulting in unstable conditions.

Accordingly, there is a need for a strap tension retaining device for use on a strapped bulk unit load. Desirably, such a device facilitates the strap retaining an acceptable range of tension following a reduction or enlargement of the bulk unit load. More desirably, such a device is small in size, and is fabricated from readily available materials in a cost effective manner.

SUMMARY OF THE INVENTION

A strap tension retaining device is configured for a use with a bulk unit load secured by one or more straps under tension. The bulk unit load with which the device is used has corners and defines a perimeter.

The strap tension retaining device facilitates an acceptable range of tension in the strap following compression or expansion of the bulk unit load. The device is small in size, and is fabricated from readily available materials in a cost effective manner. The device is readily installed on the bulk unit load.

The strap tension retaining device includes a fixed base element (fixed relative to the bulk unit load), a floating element movable relative to the fixed base element, a biasing element mounted between the floating element and the fixed base element and a guide element mounting the floating element to the fixed base element. The guide element guides movement of the floating element relative to the fixed base element. A present device includes two guides formed as posts and a spring disposed about each post between the floating element and the base element.

The strap tension retaining device is positioned at about the corner of the bulk unit load with the strap positioned around the bulk unit perimeter, over the strap tension retaining device floating element. When the strap is tensioned a force is exerted by the strap on the floating element to push the biasing element against the biasing direction. Changes in strap tension due to an increase or decrease in the bulk unit perimeter (i.e., expansion or compression of the bulk unit) are accommodated by movement of the floating element. A negative change in the bulk unit perimeter (i.e., compression) is accommodated by the floating element moving in the biasing direction to preclude slack in the strap and a positive change in bulk unit perimeter (i.e., expansion) is accommodated by the floating element moving against the biasing direction to preclude over-tensioning the strap.

In one embodiment, the posts are threaded into the fixed base element and a washer is disposed on each post outwardly of the floating element. This facilitates pre-bulk unit loading the spring to a desired force.

The floating element includes a strap traversing region formed as an inclined surface. This prevents abrading the strap and facilitates easy movement of the strap over the floating element and improves strap tension transmission.

Other features and advantages of the present invention will be apparent from the following detailed description, the accompanying drawings, and the appended claims.

BRIEF DESCRIPTION OF THE FIGURES

The benefits and advantages of the present invention will become more readily apparent to those of ordinary skill in the art after reviewing the following detailed description and accompanying drawings, wherein.

DETAILED DESCRIPTION OF THE INVENTION

Figure 1:
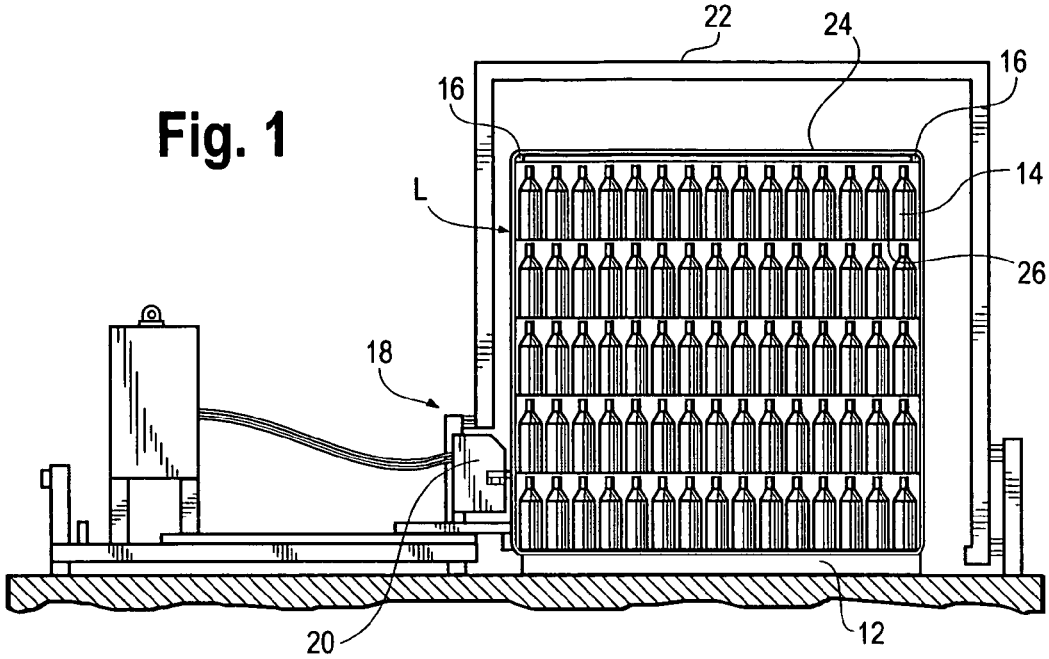
FIG. 1 is a side view of a strapping machine with a bulk unit load (pallet of bottles) in the machine having two strap tension retaining devices embodying the principles of the present invention.

While the invention is susceptible to various embodiments, there is shown in the drawings and will hereinafter be described specific embodiments with the understanding that the present disclosure is to be considered an exemplification of the invention and is not intended to limit the invention to the specific embodiments illustrated and described.

It is to be further understood that the title of this section of the specification, namely, "Detailed Description of the Invention," relates to a requirement of the United States Patent and Trademark Office, and does not imply, nor should be inferred to limit the subject matter disclosed herein and the scope of the present invention.

Referring to the figures, and in particular to FIG. 1, there is shown a strapping machine 10 having a pallet 12 of bottles 14 (or bulk unit load L) therein, and illustrating two strap tension retaining devices 16 embodying the principles of the present invention. A strapping machine 10 for such a bulk unit load L includes a strapping machine body 18, a strapping head 20, and a chute 22 through which the strap S is fed and from which the strap S is pulled during take-up and tensioning. An exemplary strapping machine is an MCD 510/BCU-3 automatic strapping machine manufactured by ITW-Signode, of Glenview, Ill.

Typically, the products (bottles 14) are on the pallet 12 and a rigid top frame or cover 24 is positioned on the top of the bulk unit load L. The rigid top frame 24 maintains an even compression on the perimeter of the bulk unit load L. Rigid sheets or separators 26 are disposed between layers of product 14. The top frame 24 can be formed from wood, polymeric, or fiberboard-type or like materials. Sheets or separators 26 can be formed from polymeric, fiberboard-type or like materials.

The strap S is pulled around the bulk unit load L (around perimeter) over the corners C of the bulk unit load L. In known arrangements, the strap S is merely pulled over or around the corners of the top frame or cover 24 and the pallet 12 bottom. In the event that a second pallet of goods is positioned on a lower pallet, or even over time, the bulk unit load L can compress (i.e., a reduction in bulk unit perimeter) and as a result, slack can develop in the strap S. If an excessive amount of slack develops, the strap is no longer in tension and the bulk unit load L is no longer held in compression. Consequently, the bulk unit load L can become unstable and goods can fall out of the unit perimeter.

Figure 2:
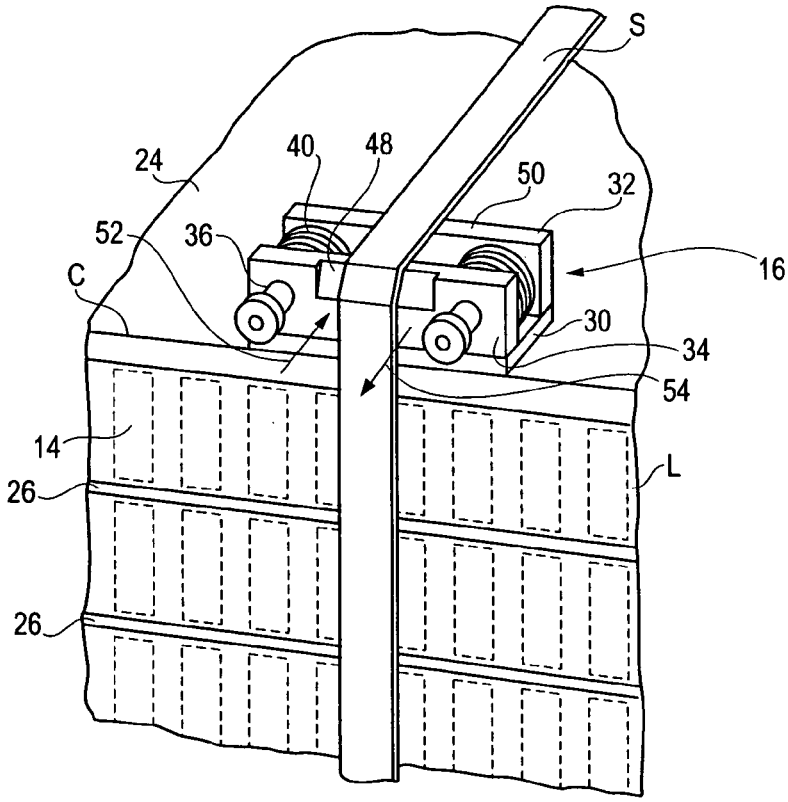
FIG. 2 is a perspective illustration of the strap tension retaining device in place on a stack of products.
Figure 3:
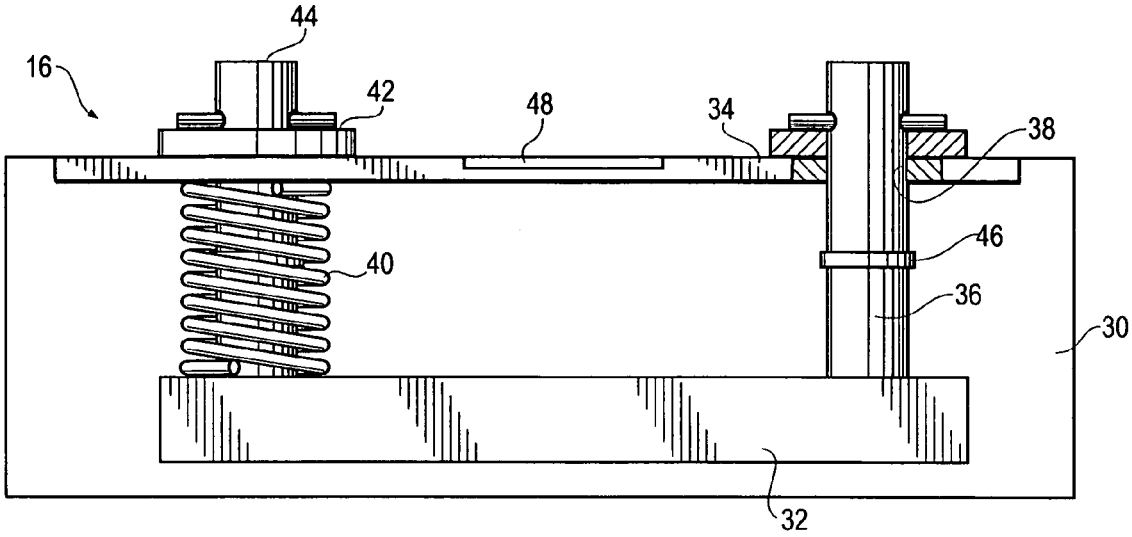
FIG. 3 is a top view of one embodiment of the tension retaining device shown with one spring removed for clarity of illustration.

The present strap tension retaining device 16 allows for some compression of the bulk unit load L, while maintaining the strap S at an established strap tension range so as to maintain the bulk unit load L in compression (thus maintaining stability and preventing the goods from falling from the bulk unit). A first embodiment of the device 16, as seen in FIGS. 2 and 3, is positioned at a corner C of the bulk unit load L at or near an edge of the cover (top frame) 24, and the strap S is positioned over or around the device 16. The device 16 includes a mounting element 30, such as the illustrated mounting plate, and a fixed base portion 32 mounted to the plate 30.

A floating element 34 is operably mounted to the base 32. In a present embodiment, one or more guide elements, such as the exemplary two posts 36 are mounted to the base portion 32. The floating element 34 is formed as a plate and includes an opening 38 corresponding to each of the posts 36 so that the floating element 34 floats on the posts 36. Biasing members 40 such as the illustrated coil springs are disposed about the posts 36 between the base 32 and the floating element 34. The springs 40 bias the floating element 34 away from the base 32 while the posts 36 retain the floating element 34 in its orientation and position relative to the base 32. A washer 42 is positioned over the post 36, between a head 44 of the post 36 (or in this case bolt) and the floating element 34. In this arrangement, the posts 36 constrain movement of the floating element 34 to the same plane as the base 32.

In the embodiment illustrated in FIGS. 2 and 3, the posts 36 are bolts or cap screws and the washer 42 is positioned about the bolt 36, against the floating element 34. The bolt 36 is threaded into the base 32 to affix the terminal position of the floating element 34 relative to the base 32. To prevent over compression of the springs 40, a post shoulder 46 can be present (e.g., formed on) one or both of the bolts 36 to limit the inward (compression-direction) movement of the floating element 34.

The spring 40 specifications (e.g., spring force) are dependent upon the required operating parameters of the strap S, the strapping system (e.g., machine 10) and the bulk unit load L. The washer 42 (between the bolt head 44 and floating element 34) can be used as a shim to change the pre-bulk unit load on the springs 40 to vary the force applied on the strap S and the force required to move the floating element 34 against the springs 40.

To facilitate smooth movement of the strap S over the floating element 34, the element 34 can include a strap groove 48. The groove can be formed as an inclined surface or ramp to reduce or minimize abrasion of the strap S as it passes over the floating element 34. The groove 48 also facilitates smooth movement of the strap S over the floating element 34 as well as maintaining strap alignment. Optionally, although not shown, the base 32 and floating element 34 can include recesses so that the strap S traverses over the device 16 below an upper surface 50 of the device 16.

In use, a pallet 12 of product 14 is strapped with the strap S traversing over the devices 16. As the strap S is tensioned around the bulk unit load L, the strap S running over the floating element 34 exerts a force (indicated by the directional arrow at 52) on the floating element 34 against the spring 40 bias (or against the bias direction). In the event that a subsequent pallet is placed on top of the (first or lower) pallet 12, even if some (external or non-strap induced) compression of the bulk unit load L occurs, the spring force on the floating element 34 (in the bias direction as indicated by the arrow at 54) maintains the strap S in tension, eliminating any slack that may develop. In this manner, the strap S is maintained in tension and the bulk unit load L is maintained under load (or in compression). This precludes instability of the bulk unit load L and the likelihood that individual items 14 of the bulk unit load L will come loose from the strapped bulk unit load. In addition, in the event that the bulk unit load L expands (bulk unit perimeter expansion), the increase in tension in the strap S could otherwise cause product damage from excessive strap tension or exceed strap burst strength (resulting in product damage or unstable conditions). The present device 16 provides some "give" in that the floating element 34 can travel toward the base (against the bias direction or in the direction indicated by the arrow at 52), thus reducing the tension in the strap S.

Figure 4:
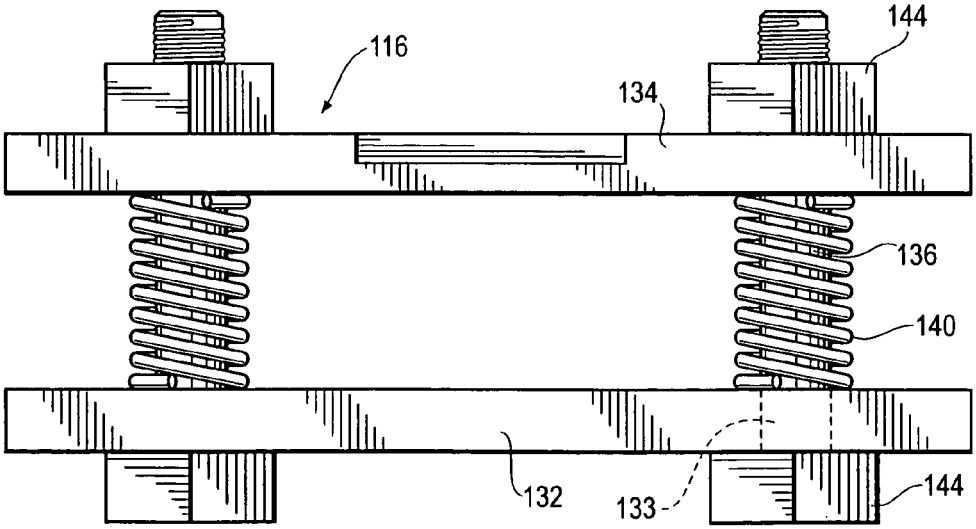
FIG. 4 is a top view of an alternate embodiment of the tension retaining device.

An alternate embodiment of the device 116 is illustrated in FIG. 4. In this embodiment, the post 136 is formed from a bolt or other threaded fastener that is inserted into an opening 133 in the base 132. The springs 140 and floating element 134 are positioned on the bolts 136 and nuts or like elements 144 are threaded onto both ends of the bolts 136 to retain the device 116 as an assembly. Although the details of construction vary somewhat in this embodiment 116, there is common to both embodiments 16, 116 the biased floating element 34, 134 that retains the strap S in tension even under compression of the bulk unit load L.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the invention. It is to be understood that no limitation with respect to the specific embodiment illustrated is intended or should be inferred. The disclosure is intended to cover by the appended claims all such modifications as fall within the scope of the claims.

What is claimed is:

1. A strap tension retaining device for use with a bulk unit load secured by a strap under tension, the bulk unit load having a corner, the bulk unit load having a perimeter, the strap tension retaining device comprising:

a fixed base element, the fixed base element being fixed to the bulk unit load;

a floating element, the floating element being movable relative to the fixed base element, the floating element having a strap traversing region;

a biasing element operably mounting the floating element and the fixed base element, the biasing element exerting a force in a bias direction; and a guide element operably mounting the floating element to the fixed base element to guide movement of the floating element relative to the fixed base element, wherein the strap tension retaining device is positioned at the corner of the bulk unit load and the strap is positioned around the bulk unit load, around the perimeter, the strap traversing over the strap tension retaining device, over the floating element strap traversing region, and wherein when the strap is tensioned, a force exerted by the strap on the floating element urges the biasing element against the bias direction, and wherein a change in the bulk unit perimeter is accommodated by movement of the floating element.

2. The strap tension retaining device in accordance with claim 1 wherein a negative change in the bulk unit perimeter is accommodated by the floating element moving in the bias direction to preclude slack in the strap.

3. The strap tension retaining device in accordance with claim 1 wherein a positive change in the bulk unit perimeter is accommodated by the floating element moving against the bias direction to preclude over-tensioning the strap.

4. The strap tension retaining device in accordance with claim 1 including two guide elements fixedly mounted to the fixed base element, and including two biasing elements.

5. The strap tension retaining device in accordance with claim 4 wherein the biasing elements are springs disposed about the guide elements, between the fixed base element and the floating element.

6. The strap tension retaining device in accordance with claim 1 including means for constraining movement of the floating element to a plane defined by the fixed element.

7. The strap tension retaining device in accordance with claim 6 wherein the means for constraining are posts extending from the fixed base element.

8. The strap tension retaining device in accordance with claim 7 wherein the floating element includes openings for receiving the posts.

9. The strap tension retaining device in accordance with claim 8 wherein the posts are threaded into the fixed base element.

10. The strap tension retaining device in accordance with claim 1 including means for limiting movement of the floating element relative to the fixed base element.

11. The strap tension retaining device in accordance with claim 10 wherein the guide element is a post and wherein the means for limiting movement of the floating element is a spacer disposed on each post outwardly of the floating element.

12. The strap tension retaining device in accordance with claim 1 wherein the floating element includes a strap traversing region formed as an inclined surface.

* * * * *